US006588100B2

(12) United States Patent
Ma et al.

(10) Patent No.: US 6,588,100 B2
(45) Date of Patent: Jul. 8, 2003

(54) METHOD FOR FORMING AN ELECTRICAL CONNECTOR AND AN ELECTRICAL CONNECTOR OBTAINED THEREBY

(75) Inventors: Xue Dong Ma, Kun-Shan (CN); Guang Xing Shi, Kun-Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 18 days.

(21) Appl. No.: 09/795,910

(22) Filed: Feb. 27, 2001

(65) Prior Publication Data

US 2002/0061686 A1 May 23, 2002

(30) Foreign Application Priority Data

Nov. 21, 2000 (TW) ..... 89124700 A

(51) Int. Cl.[7] ..... H01R 43/04

(52) U.S. Cl. ..... 29/882; 29/874; 29/883; 29/884

(58) Field of Search ..... 29/874, 882, 883, 29/884, 825

(56) References Cited

U.S. PATENT DOCUMENTS 4,593,463 A * 6/1986 Kamono et al. ..... 29/884
5,074,039 A * 12/1991 Hillbiosh et al. ..... 29/883
5,619,794 A * 4/1997 Hozazono ..... 29/883
5,768,777 A * 6/1998 Lemke ..... 29/884
6,125,535 A * 10/2000 Chiou et al. ..... 29/884
6,370,771 B1 * 4/2002 Huang ..... 29/883

* cited by examiner

*Primary Examiner*—Carl J. Arbes
(74) *Attorney, Agent, or Firm*—Wei Te Chung

(57) ABSTRACT

A method for forming a contact insert subassembly (34) for a modular jack connector (200), includes the following steps:

stamping a contact strip (10) to form a group of contacts (20) which are interconnected by an end carrier (11) and a middle carrier (13), the middle carrier dividing the contacts into first and second portions (21, 22);

bending the first portion into a soldering tail portion for the contacts;

subjecting the contact strip to an insert molding to form an insulative block (30) around the middle carrier (13);

cutting the end carrier and the middle carrier from the contacts; and bending the second portion to form a contacting portion for the contacts.

7 Claims, 6 Drawing Sheets

METHOD FOR FORMING AN ELECTRICAL CONNECTOR AND AN ELECTRICAL CONNECTOR OBTAINED THEREBY

BACKGROUND OF THE INVENTION

1. Field of the Invention

The present invention is related to a method for forming an electrical connector and an electrical connector obtained thereby. Particularly, the present invention is related to a method for forming a modular jack connector and a modular jack connector obtained thereby.

2. Description of the Prior Art

Modular jack connectors, for example, RJ-45 modular jack connectors, are widely used in computer network application. A conventional modular jack connector is formed by the following method:

a. providing a contact strip with two ends being formed with carriers and a plurality of contacts between the two carriers;

b. subjecting the strip to an insert molding to form an insulative block at a middle portion of the contacts, said insulative block dividing the contacts into first and second exposed portions;

c. stamping the first exposed portion into a contacting portion for mating with a complementary connector, and the second exposed portion into a tail portion for being soldered to a printed circuit board;

d. cutting the carriers from the contacts;

e. assembling the insulative block together with the contacts into a space defined in an insulative housing of the RJ-45 modular jack connector;

f. if necessary, a light emitting diode (LED) being mounted to the housing to indicate the connecting situation of the modular jack connector with the complementary connector; and g. enclosing the housing with a metal shell to shield the contacts from electromagnetic interference.

In the conventional method, during the insert molding, since the middle portion of the contacts, which is the most flexible part of the contacts, is subject to the high pressured molten plastics flow, the contacts may deform to deviate from their intended positions. When this happens, the signal transmitting performance of the connector is adversely affected.

Furthermore, during the bending of the first and second exposed portions to form the contacting and tail portions of the contacts, internal stress is accumulated in the contacts. Once the carriers are cut from the contacts, the contacting and tail portions may deviate from their intended positions to release the accumulated internal stress. When this happens, the contacting portion is unable to accurately mate with the complementary connector, and the tail portion is unable to accurately solder to the printed circuit board.

Hence, an improved method for forming an electrical connector is required, which can overcome the above-mentioned defects of the current art.

SUMMARY OF THE INVENTION

A first objective of the present invention is to provide a method for forming a modular jack connector and a modular jack connector obtained thereby, wherein contact dislocation due to impacting force acting on the contacts during insert molding a contact strip to form a contact insert subassembly can be effectively avoided.

A second objective of the present invention is to provide a method for forming a modular jack connector and a modular jack connector obtained thereby, wherein the problem of deviation of the contacting portion and soldering tail portion of the contacts from their intended positions due to release of accumulated internal stress by removal of contact strip carriers can be effectively improved.

To fulfill the above-mentioned objectives, a method for forming a contact subassembly of a modular jack connector comprises the steps of:

a. stamping a contact strip into a group of contacts which are interconnected by an end carrier and a middle carrier, said middle carrier divides the contacts into first and second portions, wherein the second portion is located between the end carrier and the middle carrier;

b. applying a bending operation to the first portion of the contacts to form a soldering tail portion for the contacts;

c. subjecting the contact strip to insert molding to form an insulative block around a middle portion of the contacts wherein an opening is defined in the insulative block, the opening receiving and exposing the middle carrier;

d. cutting the end carrier and the middle carrier from the contacts;

e. applying a bending operation to the second portion of the contacts to form a contacting portion for the contacts.

Other objects, advantages and novel features of the invention will become more apparent from the following detailed description of the present embodiment when taken in conjunction with the accompanying drawings.

BRIEF DESCEIPTION OF THE DRAWINGS

DESCRIPTION OF THE PREFERRED EMBODIMENT

Figure 1:
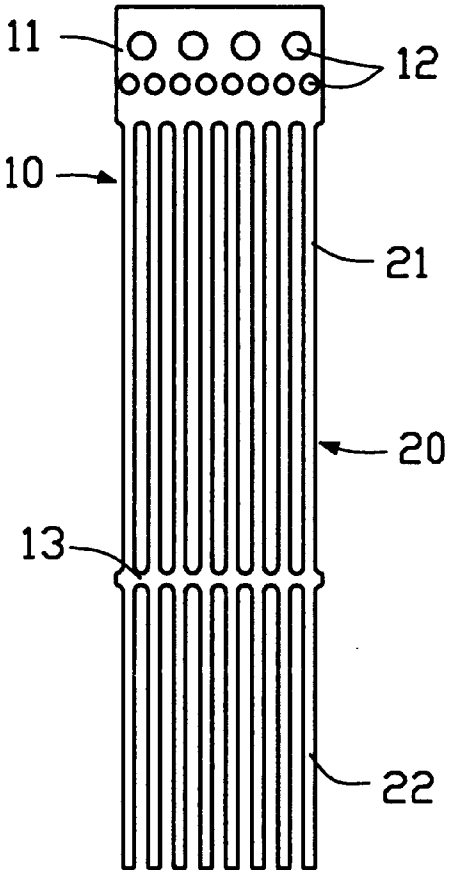
FIG. 1 is a top plan view showing a contact strip in accordance with the present invention.

Referring to FIG. 1, in order to obtain a modular jack connector 200 (see FIG. 8) in accordance with the present invention, firstly, a contact strip 10 is stamped to form a group of contacts 20. The contacts 20 are interconnected through an end carrier 11 formed at one end of the contact strip 10 and a middle carrier 13. The middle carrier 13 divides the contacts 20 into first and second portions 21, 22. The end carrier 11 defines two rows of apertures 12 therein for engaging with protrusions on a wheel of a driving mechanism (not shown) for motivating the contact strip 10 to be subject to different operations at different stations.

Figure 2:
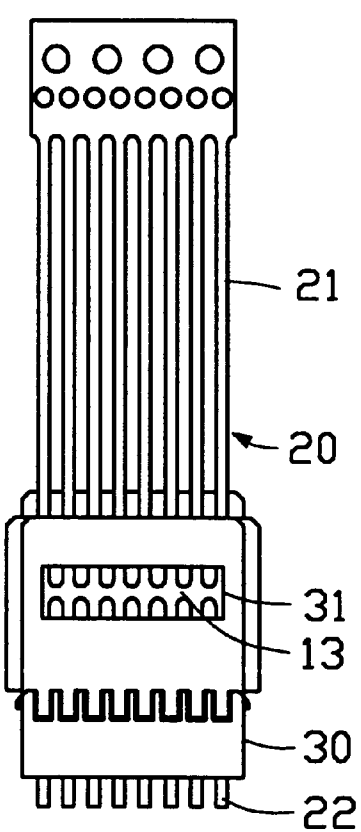
FIG. 2 is a view similar to FIG. 1 showing that the contact strip of FIG. 1 is subject to a bending operation to form a soldering tail portion and an insert molding operation to be attached with an insulative insert block.
Figure 4:
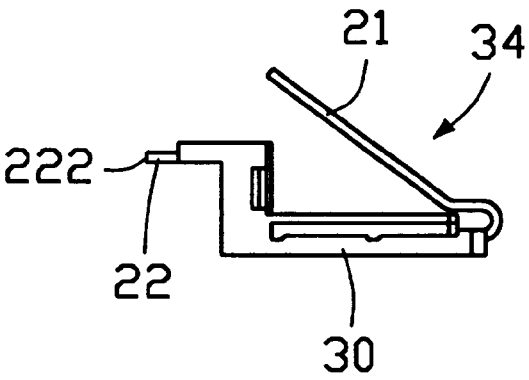
FIG. 4 is a side view showing that the contact strip of FIG. 3 is further subject to a bending operation to form a contacting portion.
Figure 3:
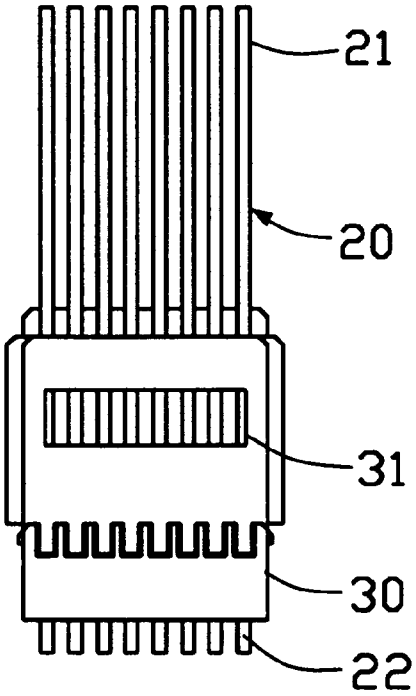
FIG. 3 is a view similar to FIG. 2 showing that a cutting operation is applied to a middle carrier and an end carrier of the contact strip of FIG. 2.
Figure 5:
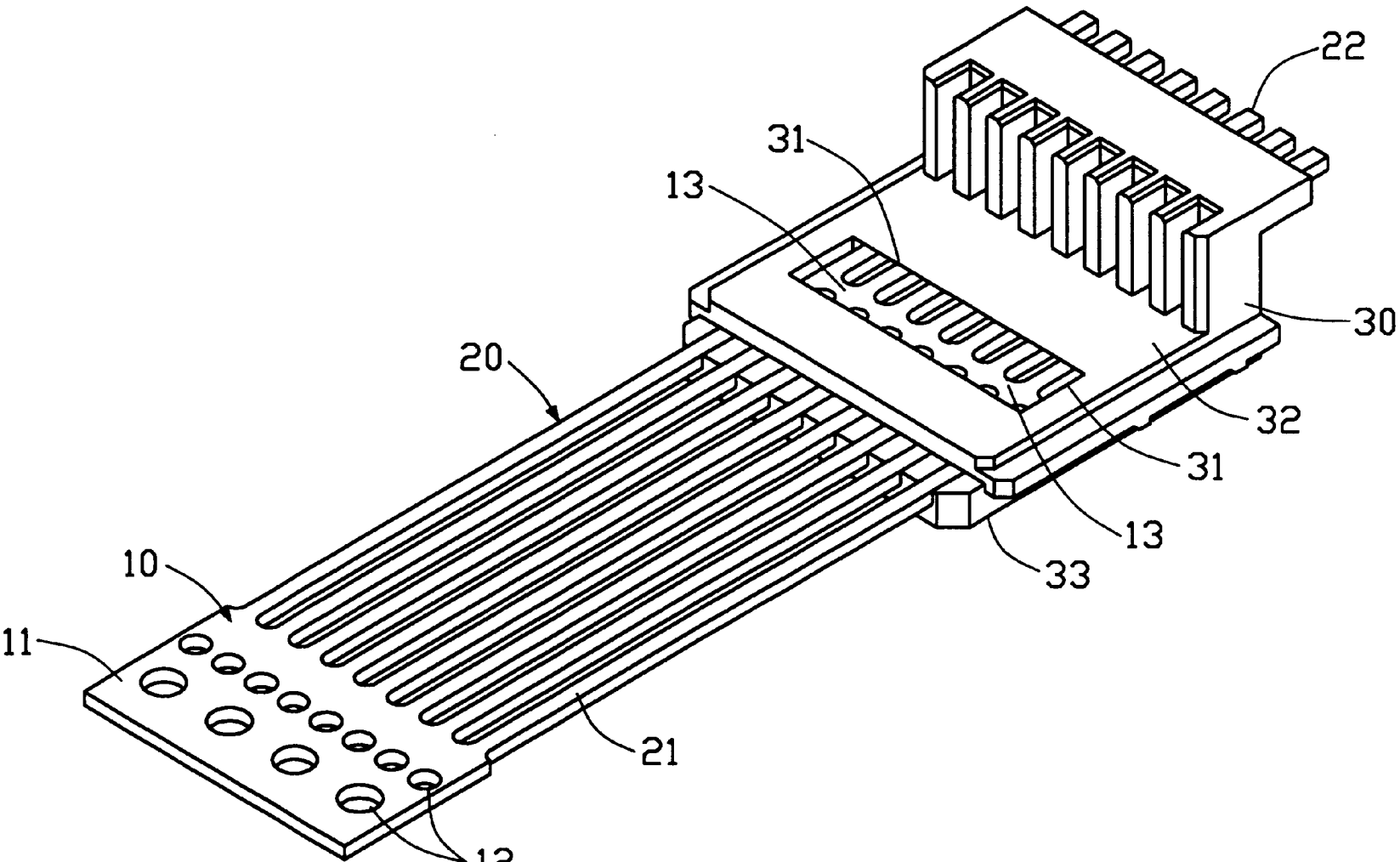
FIG. 5 is a perspective view of FIG. 2.
Figure 6:
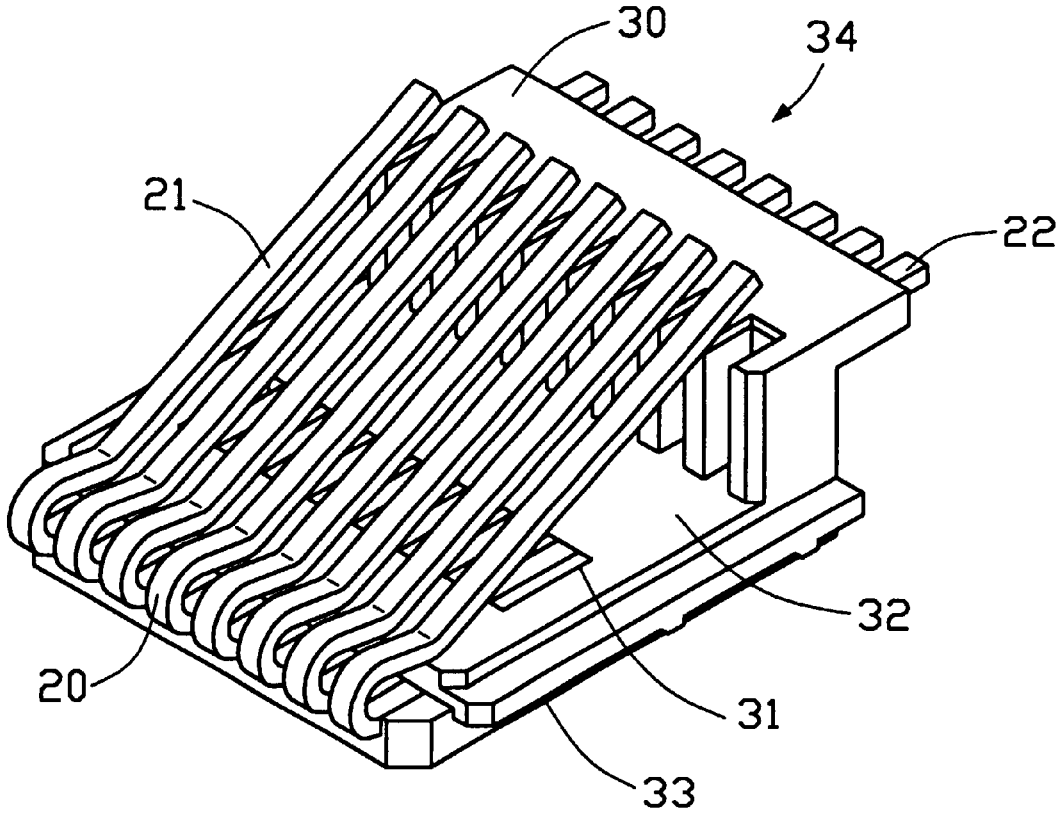
FIG. 6 is a perspective view of FIG. 4.

Then, referring to FIGS. 2 and 5, the contact strip 10 is subject to an insert molding operation to be attached with an insulative block 30 at a middle portion of the contact strip 10 after the contacts 20 is subject to a bending operation. During the bending operation, the second portion 22 of the contacts 20 is formed into a soldering tail portion 22 with a SMT (surface mounting technology) soldering end 222 being located at a level different from that the middle carrier 13 is located. As in the present invention, the most flexible middle portion of the contacts 20 is connected by the middle carrier 13, the middle portion of the contacts 20 can be correctly positioned and space from each other a suitable distance when the middle portion is subject to the high-pressured molten plastic flow during the insert molding operation. An opening 31 is defined in the insulative block 30 through an upper surface 32 and a lower surface 33 thereof. The opening 31 receives and exposes the middle carrier 13. Referring to FIG. 3, a cutting operation thereafter is applied to the end carrier 11 and the middle carrier 13 to separate the contacts 20 from each other. Finally, referring to FIGS. 4 and 6, a bending operation is applied to the first portion 21 of the contacts 20 to form a contacting portion of the contacts 20. Therefore, particularly referring to FIG. 6, a contact insert subassembly 34 is obtained.

Figure 7:
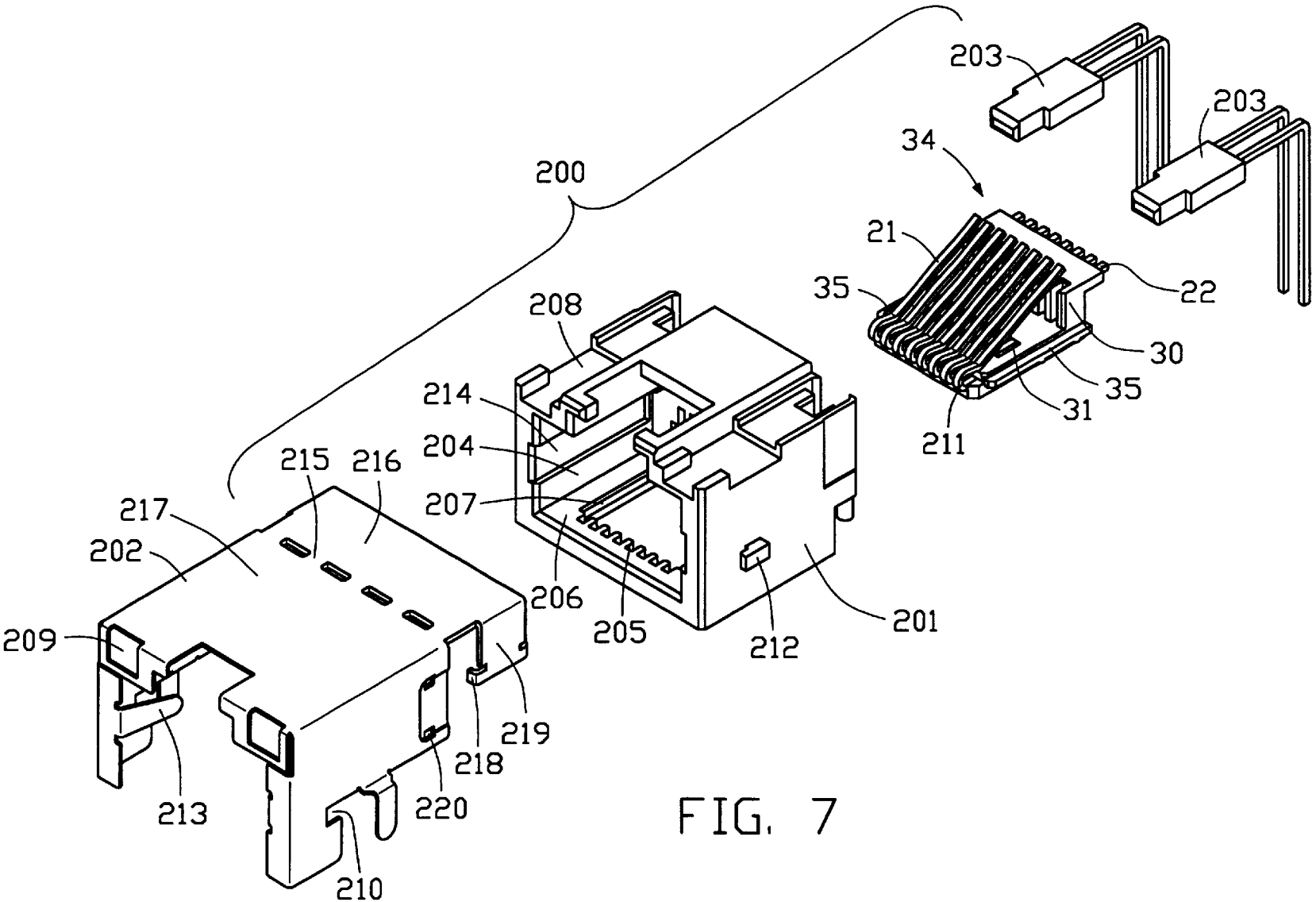
FIG. 7 is an exploded view of a modular jack connector in accordance with the present invention.
Figure 8:
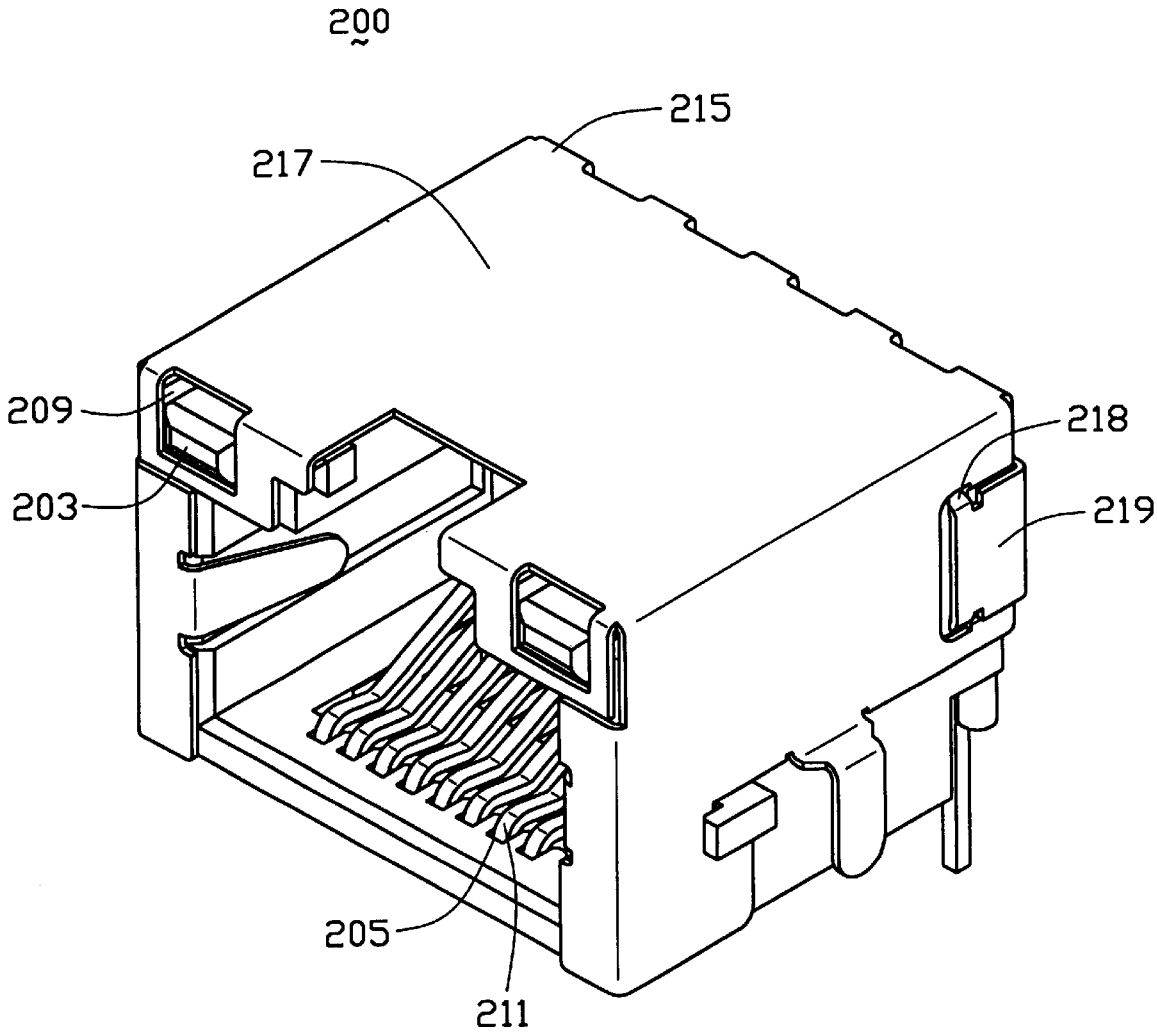
FIG. 8 is an assembled view of FIG. 7.

Referring to FIGS. 7 and 8, the modular jack connector 200 in accordance with the present invention comprises an insulative housing 201 defining a receiving space 204 for receiving the contact insert subassembly 34 obtained by the above-mentioned steps, a shield 202 for enclosing the housing 201, the contact insert subassembly 34 and a pair of light emitting diodes 203. In assembly, the contact insert subassembly 34 is inserted into the receiving space 204 from a rear side of the housing 201 to a position in which a curved section 211 of the contacting portion 21 of the contacts 20 is fitted into a corresponding depression 205 defined in a front portion of a bottom wall 206 of the housing 201, and side ribs 35 of the insulative block 30 are fitted into recesses 207 defined in the bottom wall 206 and located beside and in rear of the depression 205. The light emitting diodes 203 are then fitted into two sides of a top wall 208 of the housing 201. Finally, the shield 202 is mounted to enclose the housing 201. The shield 212 has two windows 209 through which the light emitting diodes 203 are exposed, two recesses 210 fittingly receiving two L-shaped projections 212 formed on an outer face of two side walls of the housing 201, and two grounding tabs 213 extending into the receiving space 204 and located corresponding to two grooves 214 defined in an inner face of the two side walls of the housing 201. A perforated line 215 is defined in the shield 202 between a main body 217 and a rear portion 216 of the shield 202. After the shield 202 is mounted to the housing 201, the rear portion 216 is bent relative to the main body 217 along the perforated line 215 to reach a position in which fingers 218 formed on flaps 219 of the rear portion 216 latch into holes 220 defined in side walls of the main body 217 thereby fixing the shield 202 to the housing 201, as shown in FIG. 8.

It is to be understood, however, that even though numerous characteristics and advantages of the present invention have been set forth in the foregoing description, together with details of the structure and function of the invention, the disclosure is illustrative only, and changes may be made in detail, especially in matter of shape, size, and arrangement of parts within the principles of the invention to the full extent indicated by the broad general meaning of the terms in which the appended claims are expressed.

We claim:

1. A method for forming a contact insert subassembly of a modular jack connector, the modular jack connector having an insulative housing defining a space receiving the contact insert subassembly therein, the method comprising the following steps:

a. stamping a contact strip into a group of contacts which are interconnected by an end carrier and a middle carrier, said middle carrier dividing the contacts into first and second portions in which the second portion is located between the middle carrier and the end carrier;

b. applying a bending operation to the first portion of the contacts to form a soldering tail portion for the contacts;

c. subjecting the contact strip to an insert molding operation to form an insulative block at a middle position of the contacts;

d. cutting the end carrier and the middle carrier from the contacts; and e. applying a bending operation to the second portion of the contacts to form a contacting portion for the contact;

wherein during insert molding operation, the insulative block is formed with an opening which is defined for receiving and exposing the middle carrier so that the cutting operation can be readily applied to the middle carrier.

2. The method as claimed in claim 1, wherein the soldering tail portion has a SMT soldering end located at a level different from that the middle carrier is located.

3. The method as claimed in claim 1, wherein the insulative block has side ribs for fitting within recesses defined in a bottom wall of the insulative housing of the modular jack connector.

4. A method for forming an electrical connector, comprising the following steps:

a. forming a contact insert subassembly, comprising the following steps:

(i) stamping a contact strip into a group of contacts which are interconnected by an end carrier and a middle carrier, said middle carrier dividing the contacts into first and second portions in which the second portion is located between the middle carrier and the end carrier;

(ii) applying a bending operation to the first portion of the contacts to form a soldering tail portion for the contacts;

(iii) subjecting the contact strip to an insert molding operation to form an insulative block at a middle position of the contacts, said insulative block defining therein an opening to receive the middle carrier;

(iv) cutting the end carrier and the middle carrier from the contacts; and (v) applying a bending operation to the second portion of the contacts to form a contacting portion for the contacts;

b. mounting the contact insert subassembly in an insulative housing of the electrical connector.

5. The method as claimed in claim 4 further comprising the following step after step b:

c. mounting a shield to the housing to enclose the housing.

6. The method as claimed in claim 5 further comprising the following step between steps b and c:

mounting light emitting diodes to the insulative housing of the electrical connector.

7. The method as claimed in claim 5, wherein the shield has a rear portion and a main body which are connected with each other through a perforated line, the mounting of the shield to the housing including to bend the rear portion relative to the main body along the perforated line and have at least a finger formed on the rear portion latch into at least a hole defined in the main body.

* * * * *